United States Patent [19]

Perrigo

[11] Patent Number: 5,035,373

[45] Date of Patent: Jul. 30, 1991

[54] CONSTANT CONTACT LAY-ON ROLL WINDER

[75] Inventor: Michael C. Perrigo, Staten Island, N.Y.

[73] Assignee: John Brown, Inc., Warwick, Conn.

[21] Appl. No.: 882,966

[22] Filed: Apr. 8, 1986

[51] Int. Cl.[5] ..... B65H 19/20

[52] U.S. Cl. ..... 242/56 A; 242/67.2

[58] Field of Search ..... 242/64, 76, 67.2, 56 A, 242/67.1 R, 75.1, 75.2

[56] References Cited

U.S. PATENT DOCUMENTS

| | | | |
|---|---|---|---|
| 3,478,975 | 11/1969 | Penrod | 242/64 |
| 3,630,462 | 12/1971 | Nordgren | 242/56 A X |
| 3,966,136 | 6/1976 | Newberry | 242/67.2 X |
| 4,004,747 | 1/1977 | Schulze | 242/67.2 X |
| 4,069,986 | 1/1978 | Carlsen | 242/56 A |
| 4,150,797 | 4/1979 | Kataoka | 242/75.2 X |
| 4,266,735 | 5/1981 | Leanna et al. | 242/64 X |
| 4,335,857 | 6/1982 | Pfost | 242/76 X |
| 4,343,440 | 8/1982 | Engl | 242/671 R |
| 4,431,140 | 2/1984 | Tetro | 242/64 X |
| 4,524,919 | 6/1985 | Wehrmann | 242/67.1 R |
| 4,529,141 | 7/1985 | McClenathan | 242/56 A |
| 4,541,583 | 9/1985 | Forman et al. | 242/64 X |

*Primary Examiner*—Katherine A. Matecki

*Attorney, Agent, or Firm*—Robert J. Ferb

[57] ABSTRACT

An improved turret type winder incorporates articulated constant contact lay-on rolls mounted concentrically with chucks at the ends of the arms of the turret winder. The articulated constant contact lay-on rolls are continuously repositioned radially during winding and are able to either maintain constant pressure or to reduce lay-on roll pressure as the film bundle diameter increases. Web tension variations during transfer operations are minimized by maintaining an essentially constant wrap angle on the lay-on roll between the web and the lay-on roll. An improved web feed-in mechanism is incorporated to reduce web tension variations due to drag forces. An improved method for winding film bundles is also provided whereby the nip pressure is varied during winding and then maintained at an about constant value during turret rotation.

5 Claims, 14 Drawing Sheets

CONSTANT CONTACT LAY-ON ROLL WINDER

BACKGROUND

1. Field of the Invention

This invention deals with the field of devices called turret winders which are used to wind webs of film type materials on cores.

A typical turret winder is comprised of a rotatable turret containing two pairs of rotating chucks located 180 degrees apart from each other at the ends of a pair of turret arms. These turret winders can produce bundles of film up to 24 to 30 inches in diameter. Turret winders with three or four pairs of chucks are also available but these winders produce smaller bundles 12 to 14 inches in diameter.

The use of two pairs of chucks to hold two cores permits the web winding to be done essentially continuously. Winding begins on one core and then after a bundle is accumulated on the core, the turret arms are rotated 180 degrees and the web is transferred to the second core and winding continues uninterrupted. Often the cores are surfaced with an adhesive strip to facilitate web transfer to the new core.

While the second core is accumulating a bundle, the first core with its bundle is removed, either manually or automatically, and a new core is loaded into the chucks. When the second core has accumulated a bundle, the turret is again rotated and the web transferred to the core in the first set of chucks. These operations are then repeated until the desired number of bundles have been wound.

When a web of film is wound, it forms a bundle of predetermined diameter corresponding to a particular length of the film material depending on the thickness of the film.

During a typical winding operation, the web is wound on a core approximately 3 $\frac{3}{8}$ inches in diameter at the rate of up to 1500 feet per minute. At the end of the winding cycle typically bundles contain 2000 to 6000 feet of film and range from 8 to 12 inches in diameter. These bundles of film are usually accumulated in two to four minutes of winding. However larger bundles containing as much as 40,000 feet of film are also wound in cycles of thirty minutes or more.

In a typical operation, the web is a deformable elastic material which must be wrapped on the bundle without entrapment of air between the accumulating layers.

A lay-on roll is usually used to eliminate the entrapment of air when the web is wound on the bundle. This lay-on roll rides on the surface of the bundle as the web is wrapped and presses the web on to the rotating bundle to prevent air from being trapped under the web as it is wrapped on the bundle. This lay-on roll also influences the tension in the web and the hardness of the bundle. The hardness is in part a function of the pressure exerted on the bundle by the lay-on roll and the counter-acting force from web tension. The resulting pressure at the nip where the lay-on roll actually presses the web onto the bundle and the tension in the web as it is wound determine bundle hardness. The web tension is adjusted by conventional means in the web feed-in system.

Proper web tension and lay-on roll pressure must be maintained to form a hard bundle without so much tension that the bundle telescopes or more typically, with film that tends to cling, a non-cylindrical barrel shaped bundle is formed. When telescoping occurs, the inner layers of a bundle are squeezed out axially resulting in a bundle width that is larger than the width of the web as it is wound. A barrel shaped bundle is narrower than the width of the unwound web and very often has circumferential wrinkles in the bundle of film. In addition, if web tension and lay-on roll pressure are to low a soft bundle is produced with wrinkles from trapped air. If web tension and lay-on roll pressure vary over too wide a range during winding this will produce a bundle with soft portions overlaid by hard portions. When this occurs a bundle with ridges induced in the soft portions by the compression from the high tension hard portions is produced. All of these irregularities can result in customer rejection of the bundle.

As indicated above, when the desired bundle diameter has been reached, the turret arms are rotated 180 degrees so that the second pair of chucks, which also hold an empty core are moved into position to begin the winding operation. In a typical application, winding of the web continues during the turret rotation operation.

This turret rotation operation typically consumes 20 to 30 seconds and approximately 300 to 500 feet of web is wound on the bundle during this operation at web winding rates of 1000 to 1500 feet per minute.

During turret rotation on a typical turret winder, lay-on roll contact with the bundle is lost. For many types of materials, when this occurs, the web that is accumulated on the bundle during the turret rotation operation traps air between the successive layers. In addition, web tension often varies substantially. These factors cause unacceptable wrapping of the web during turret rotation. This poorly wrapped portion of the web must be removed manually from the bundle and discarded or reprocessed as scrap.

At typical bundle sizes and web winding rates, this scrap can represent 10 to 15 per cent of the total web actually wound on a core.

The conventional web feed in mechanisms which function to prepare the web for winding are also the source of variations in web tension which contribute to unsatisfactory wound bundles of film.

In a typical feed in mechanism the web travels over feed rolls which are driven by a variable speed motor and a bowed roll. The bowed roll is a roll, with a rubber cylindrical sleeve mounted on a number of bearings which are supported on a cylindrical shaft which is curved or "bowed" along its longitudinal axis. As the web passes over this bowed roll the film is stretched slightly in the direction transverse to its direction of travel and any wrinkles in the web are removed.

In a conventional feed in mechanism web tension is controlled by measuring web tension, by measuring or sensing the force exerted by the web on a float roll and using that force to adjust the speed of the core chuck drive motor. The speed of the motor which controls the feed rolls must also be adjusted simultaneously to match the speed change in the core chuck drive motor. In practice, while these systems function reasonably effectively, speed variation between the chuck core drive motor and the feed roll motor cause web tension variations which adversely affect the winding operation. In addition, because the web is stretched slightly as it traverses the bowed roll and the bowed roll rotation is imparted by the web a further undesirable 2. Prior Art There are several approaches described in the prior art relating to turret winders which incorporate lay-on rolls to control roll hardware, web tension and eliminate air entrapment.

The use of pivotally mounted pressure rolls for this purpose is known in the art. The U.S. Patent of ENGL No. 4,343,440 incorporates a pivotally mounted pressure roll as does the U.S. Patent of PENROD No. 3,478,975.

Also included among these is an apparatus and method described in the U.S. Patent of TETRO No. 4,431,140 incorporating pivotally mounted pressure rolls with accompanying guide rolls mounted on pivot arms which are mounted on plates concentric with the turret shaft axis. This device also is configured to require loading of cores on one side of the device and unloading completed bundles on the opposite side. This loading arrangement is contrary to the usual practice of loading and unloading at the same location. In addition, with the apparatus described in TETRO, when the turret is rotated from the winding position to the unloading position, the wrap angle of the web on the pressure lay-on roll is increased substantially from the angle occurring during the winding operation. Finally, the TETRO apparatus requires that an adhesive strip must be placed on a new core to facilitate the transfer of the film web to the core at the beginning of the winding process.

OBJECTS AND SUMMARY OF THE INVENTION

The present invention, the improved constant contact lay-on rollwinder was conceived to include the following objectives:

1. An improved turret type winder that maintains lay-on roll contact with the bundle throughout turret arm rotation during the core transfer operation.
2. An improved turret type winder that maintains an essentially constant wrap angle between the web and the lay-on roll during core transfer operations.
3. An improved turret type winder that can reduce lay-on roll pressure as bundle diameter increases to avoid telescoping of the bundle of film.
4. An improved turret type winder that incorporates an articulated constant contact lay-on roll to virtually eliminate poor winding and scrap formation during core transfer operations.
5. An improved turret type winder that provides for a constant contact lay-on roll and permits core loading and unloading from the same location in accordance with conventional practices.
6. An improved turret type winder that provides for web transfer to new cores without the need for adhesive strips on the new cores.
7. An improved turret type winder that maintains web tension and lay-on roll pressure to minimize air entrapment and web tension variation to avoid wrinkles and ridges and the resulting film distortion in the wound bundle.
8. An improved turret type winder that incorporates a float roll, free wheeling driven feed rolls, a clutch driven bowed roll and a core drive control to maintain web tension.
9. An improved winding method in which nip pressure is varied during winding and then maintained essentially constant by maintaining an essentially constant wrap angle during turret rotation.

These objects are accomplished by incorporating a constant contact lay-on roll mounted on articulated arms mounted concentrically with the core chucks on the arms of the turret winder.

These articulated arms are rotatably mounted to permit continuously repositioning of the constant contact lay-on roll during rotation of the turret arms when core transfers are accomplished. In addition, the portion of the articulated arms on which these constant contact lay-on rolls are mounted pivot to permit positioning of the constant contact lay-on rolls on the bundle as it is wound while varying the pressure exerted on the bundle by the constant contact lay-on roll to reduce pressure as the bundle diameter is increased.

Web tension is controlled by a series of web feed-in rolls including a float roll, driven feed rolls which are free to rotate on their drive shafts, a clutch driven bowed roll and a core speed drive control to maximize float roll control responsiveness to core speed changes and to minimize web tension variations due to speed variations between the speed of the chuck core drive and feed in mechanism.

BRIEF DESCRIPTION OF THE DRAWING

The following drawings depict the preferred embodiment of the invention.

FIG. 4 illustrates the positions of the articulated arms and the constant contact lay-on rolls at the start of the transfer operation, the rotational index of the turret arms is 0 degrees, the turret arms are horizontal and the core mounted in the "A" chucks has a full bundle.

FIG. 5 illustrates the position of the articulated arms and the constant contact lay on rolls and the turret arms after counter clockwise rotation to an index position of 45 degrees.

FIG. 6 illustrates the position of the articulated arms and the constant contact lay-on rolls and the turret arms after counter clockwise rotation to an index position of 90 degrees.

FIG. 7 illustrates the position of the articulated arms and the constant contact lay-on rolls and the turret arms after counter clockwise rotation to an index position of 135 degrees.

FIG. 8 illustrates the position of the articulated arms and the constant contact lay-on rolls and the turret arms after counter clockwise rotation to an index position of 180 degrees with the J-arm in position to cut off the web to begin winding on a new core.

FIG. 9 shows the position of the articulated arm after web cutting has been completed and the constant contact lay-on roll has been moved into contact with the core in the "B" chucks.

DETAILED DESCRIPTION OF THE INVENTION

Figure 1:
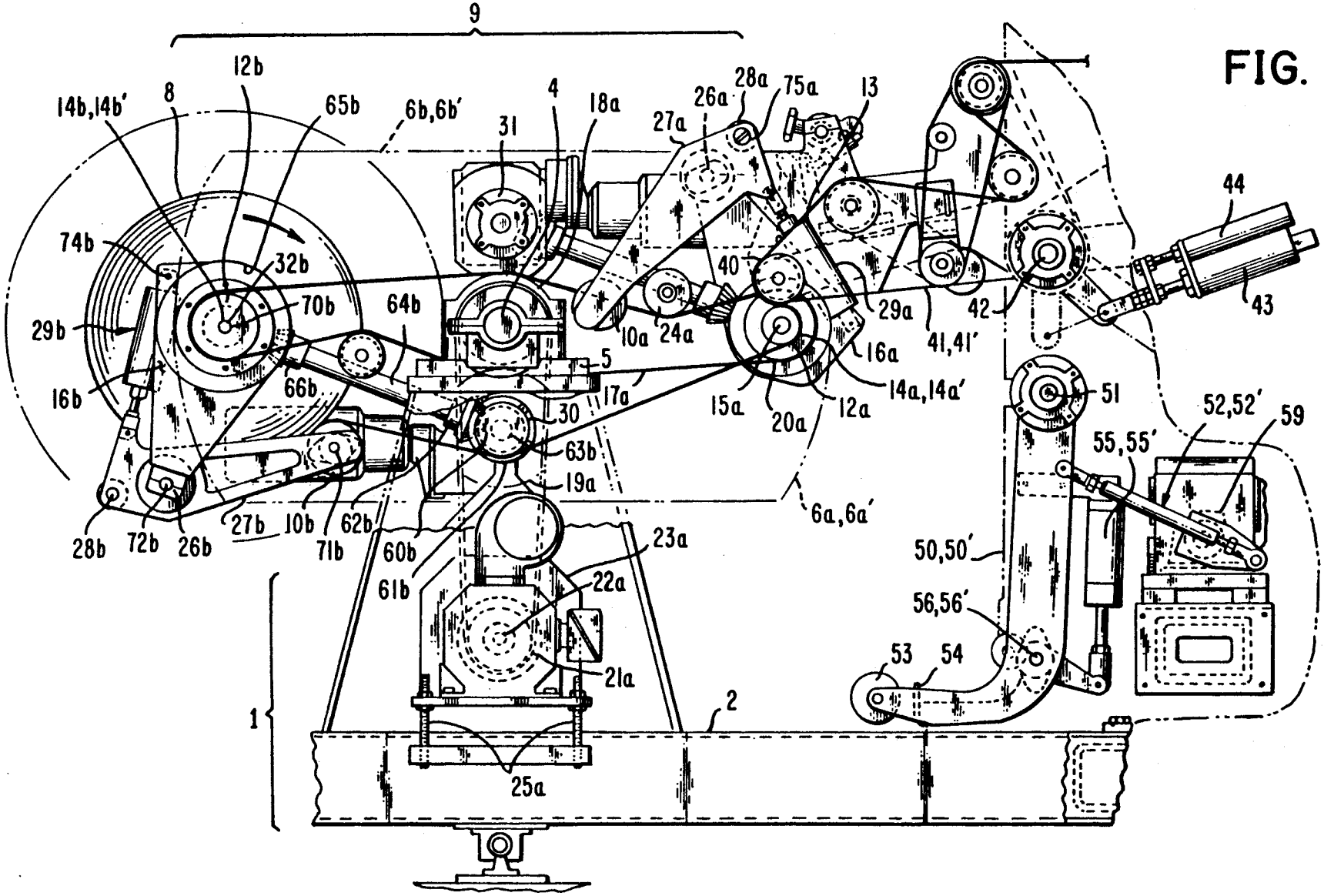
FIG. 1 is a side elevation view of the turret winder showing the articulated arms mounted on the turret arms their position near the end of a winding cycle. winding.

This invention as shown in FIG. 1, a side elevation view, illustrates Turret Winder 1 mounted on Frame 2 which supports Turret Cross Shaft 4 mounted on cross shaft bearing 5. Turret Arms 6 and 6' which are further comprised of right and left portions labeled 6*a* and 6*a*' and 6*b* and 6*b*' respectively are fixedly mounted on Turret Cross Shaft 4 and rotate clockwise when Turret Arm Positioning Motor 3 (Shown in FIG. 2) causes Turret Cross Shaft 4 to rotate. The entire Turret Arm Assembly 9 rotates as a unit in response to rotation of Turret Arm Positioning Motor 3.

A pair of Core Chucks 14*a* and 14*a*' are mounted near the end of Turret Arms 6*a* and 6*a*' respectively. Core Chuck 14*a* is fixedly attached to Chuck Drive Shaft 15*a* which is fixedly attached to Chuck Drive Pulley 20*a*. Chuck Drive Pulley 20*a* driven by Drive Belt 17*a* which is in turn driven by Drive Pulley 18*a* which is rotatably mounted on Turret Cross Shaft 4 and is driven in turn by Drive Belt 19*a*. Drive Belt 19*a* is driven by Drive Pulley 21*a* which is fixedly attached to Shaft 22*a* on Chuck Drive Motor 23*a*.

Tension in Drive Belt 17*a* is adjusted by repositioning Tension Pulley 24*a* which is moveably mounted on Turret Arm 6*a*.

Tension in Drive Belt 19*a* is adjusted by raising or lowering Chuck Drive Motor 23*a* on Motor Mounting Bolts 25*a*.

Pivot Arm 16*a* is rotatably mounted on Chuck Drive Shaft 15*a*. Pivot Pin 26*a* is mounted on Pivot Arm 16*a* on the end opposite to the point of attachment of Pivot Arm 16*a* to Chuck Drive Shaft 15*a*. Lever Arm 27*a* is rotatably mounted on Pivot Pin 26*a*. One end of Constant Contact Lay-on Roll 10*a* is rotatably attached to one end of Lever Arm 27*a* at the other end of Lever Arm 27*a* one end of Counterweight 28*a* is fixedly attached at a point beyond the point at which Lever Arm 27*a* is mounted on Pivot Pin 26*a*. At this same end of Lever Arm 27*a*, one end of Lever Positioner 29*a* is rotatably attached. The other end of Lever Positioner 29*a* is rotatably attached to Pivot Arm 16*a*.

In this figure, FIG. 1, winding of Web 13 on Core 12*b* to form Bundle 8 is nearly complete and Turret Arm Assembly 9 has already rotated 180 degrees from the normal winding position so that at this point Core 12*a* is positioned for the beginning of the winding operation. At this point in the operation Web 13 is carried over Transfer Lay-On Roll 40 which is rotatably supporting at each end by Transfer Arms 41 and 41' which in turn are pivotally mounted on Transfer Arm Shaft 42. Transfer Arms 41 and 41' are positioned by means of Positioner Device 43. Web 13 wraps around Core 12*a* in a clock wise direction from Transfer Lay-on Roll 40 and then passes over Idler Roll 30 before passing under Constant Contact Lay-on Roll 10*b* to be wound on Bundle 8.

J-arms 50 and 50' are pivotally mounted on J-arm Shaft 51 and are positioned by J-arm Positioning Devices 52 and 52' respectively. J-arm Idler Roll 53 is rotatably mounted on the end of J-arms 50 and 50'.

Web Knife 54 is mounted between J-arm 50 and 50' on Web Knife Pivots 56 and 56' which are pivotally mounted on J-arms 50 and 50' and is activated by Knife Actuators 55 and 55'. Knife Actuators 55 and 55' which are rotatably attached to one end of Web Knife Pivot 56 and 56' respectively are rotatably mounted on respective J-arms 50 and 50'.

A second pair of Core Chucks 14*b* and 14*b*' are mounted at the opposite end of Turret Arm Assembly 9 on Turret Arms 6*b* and 6*b*'. Core Chucks 14*b* and 14*b*' rotatably support Core 12*b* between Turret Arms 6*b* and 6*b*'. Core Chuck 14*b* is rotatably attached to Turret Arm 6*b* on Chuck Spindle 32*b*. Pivot Arm 16*b* is rotatably mounted on Chuck Spindle 32*b*. Pivot Pin 26*b* is mounted on Pivot Arm 16*b* on the end opposite to Pivot Arm 16*b*'s attachment to Chuck Spindle 32*b*. Lever Arm 27*b* is rotatably mounted on Pivot Pin 26*b*. One end of Constant Contact Lay-On Roll 10*b* is rotatably attached to one end of Lever Arm 27*b*. At the other end of Lever Arm 27*b* one end of Counter Weight 28*b* is fixedly attached at a point beyond the point at which Lever Arm 27*b* is mounted on Pivot Pin 26*b*. At this same end of Lever Arm 27*b* one end of Lever Positioner 29*b* is rotatably attached.

The other end of Lever Positioner 29*b* is rotatably attached to Pivot Arm 16*b*.

Pivot Arm 16*b* is oriented circumferentially around Chuck Spindle 32*b* relative to Turret Arm 6*b* by Pivot Arm Locating Motor 60*b*. Locating Motor 60*b* which is mounted on Turret Arm Assembly 9 is fixedly attached to Pivot Arm Locating Motor Output Shaft 63*b*. Motor Gear 61*b* is fixedly mounted on Locating Motor Output Shaft 63*b*. Motor Gear 61*b* engages Shaft Gear 62*b* which is fixedly attached to Drive Shaft 64*b*. Drive Shaft 64*b* is rotatably mounted on Turret Arm 6*b* and engages Pivot Arm Drive Gear 65*b* by means of Shaft Gear 66*b*. Pivot Arm Drive Gear 65*b* is fixedly mounted on Pivot Arm 16*b*.

Figure 2:
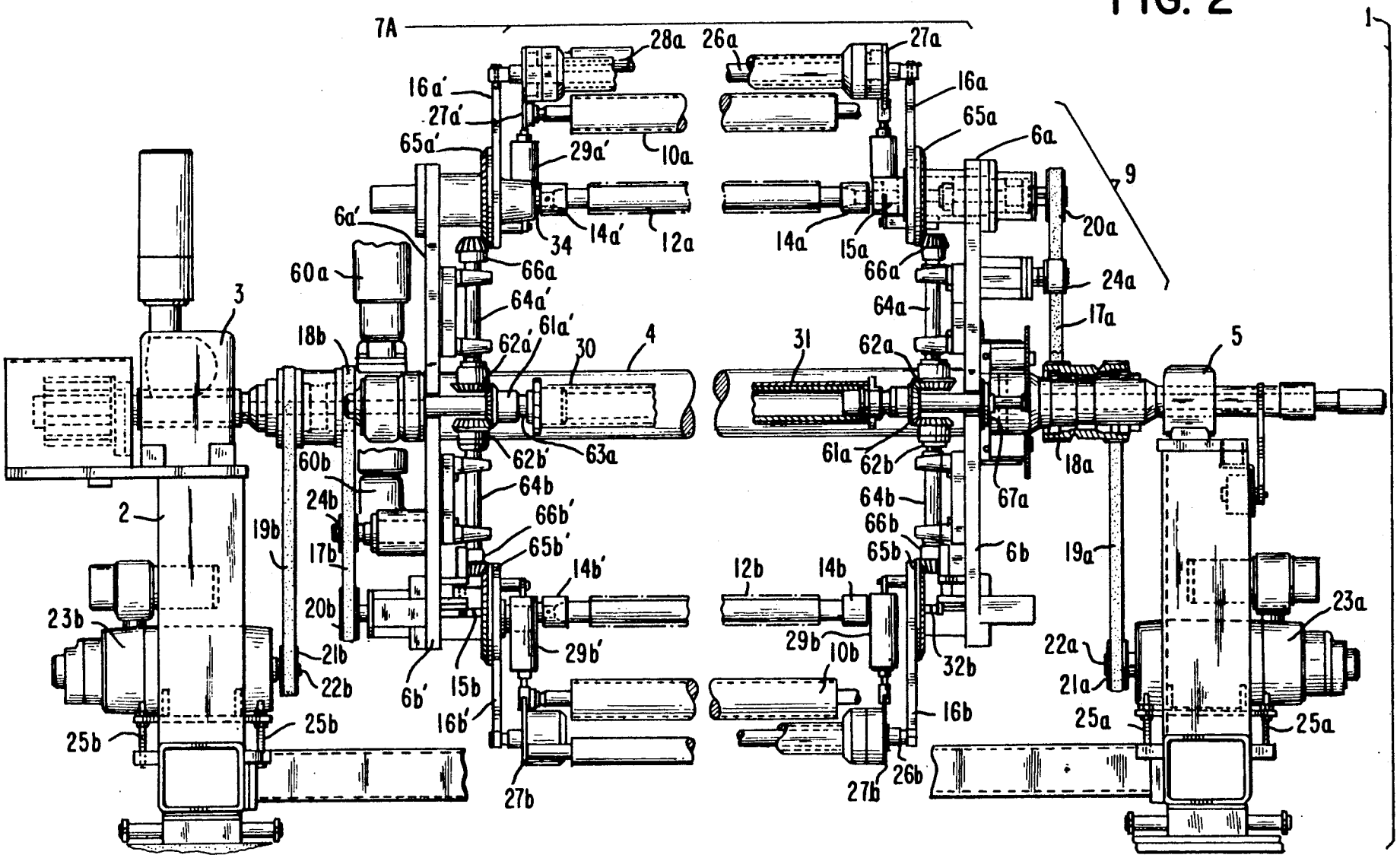
FIG. 2 is an end elevation view of the turret winder with the turret arms in a vertical position.

FIG. 2, an end elevation view of the invention, illustrates Turret Winder 1 with Turret Arm Assembly 9 in a vertical position. Turret Cross Shaft 4 is supported and driven by Turret Cross Shaft Positioning Motor 3 on one end and is supported on the other end by Turret Cross Shaft Bearing 5. Turret Arms 6*a*' and 6*b*' which are fixedly attached to Turret Cross Shaft 4 serve as mountings for Pivot Arm Locating Motors 60*a* and 60*b*.

Pivot Arm Locating Motor 60*a* drives Pivot Arm Locating Motor Output Shaft 63*a* which is supported at the end opposite from Pivot Arm Locating Motor 60*a* by Support Bearing 67*a* which is mounted on Turret Arms 6*a* and 6*b*.

Idler Roll 31 is rotatably supported by Pivot Arm Locating Motor Output Shaft 63*a*.

Motor Gears 61*a* and 61*a*' are fixedly mounted on Pivot Arm Locating Motor Output Shaft 63*a* and are positioned to engage Shaft Gears 62*a* and 62*a*' respectively to rotate Pivot Drive Gears 65*a* and 65*a*' via Drive Shafts 64*a* and 64*a*' and Shaft Gears 66*a* and 66*a*' around the axis of Core 12*a*. Since pivot drive gears are fixedly attached to Pivot Arms 16*a* and 16*a*', rotation of Articulated Arm Assembly 7*a* can be accomplished.

Figure 3:
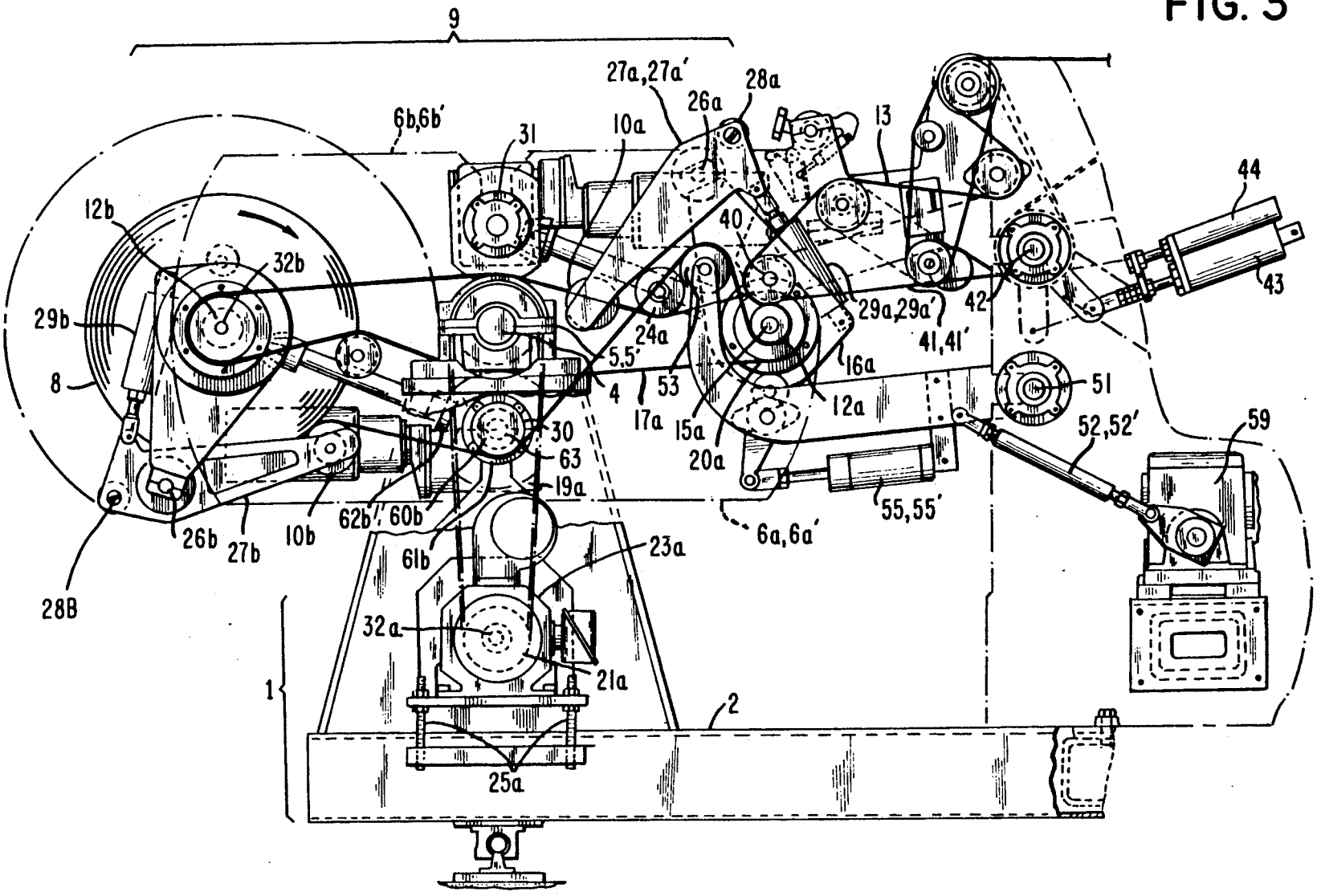
FIG. 3 is an elevation view of the turret winder showing the articulated arms in position for transfer of the web to a new core.

FIG. 3 is also a side elevation view of the invention, similar to FIG. 1, which illustrates the components of Turret Winder 1 in position for the transfer of web 13 to an empty core 12*a*.

In this figure a full bundle 8, is shown on core 12*b*. Web 13 is wound around Transfer Lay-on Roll 40 which is brought into contact with core 12*a*. Transfer Lay-on Roll 40 has been brought into contact with core 12*a* by counter clockwise rotation of Transfer arms 41 and 41′ on Transfer Arm Shaft 42 by Transfer Arm Positioning Device 43.

Web 13 is wound around Core 12*a* and from Core 12*a* wound around J-arm Idler Roll 53. From J-arm Idler Roll 53 Web 13 is wound around Idler Roll 30. From Idler Roll 30 Web 13 contacts Constant Contact Lay-on Roll 10*b* which is in contact with Bundle 8 on Core 12*b*.

In this figure Lever Arms 27*a* and 27*a*′ have been raised to their maximum position away from Core 12*a*. This is accomplished by Lever Positioners 29*a* and 29*a*′.

THEORY OF WINDER OPERATION

FIGS. 4 through 10 illustrate the functioning of Articulated Arm Assemblies 7*a* and 7*b* during bundle formation and core transfer operations.

Figure 4:
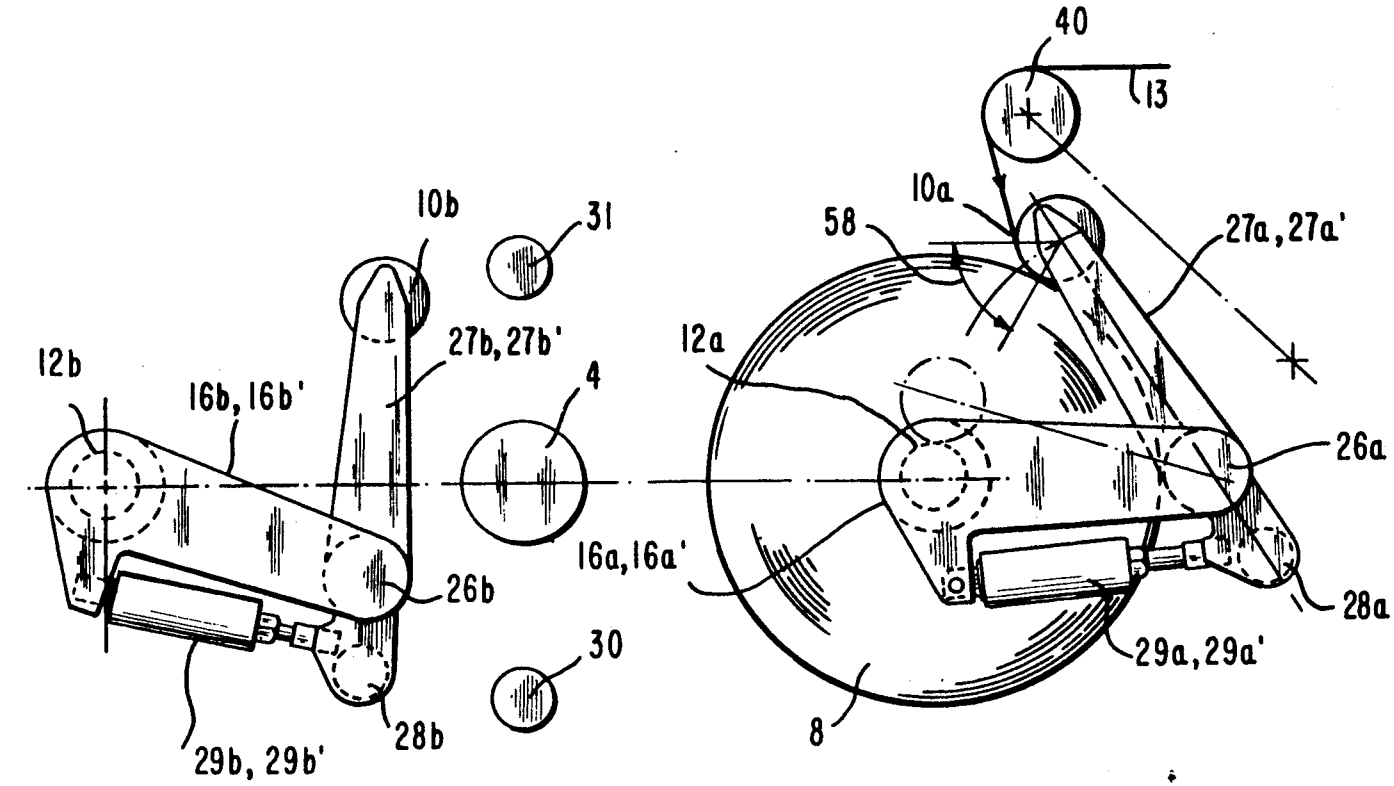
FIGS. 4 through 9 show the articulated arms and the constant contact lay-on rolls at various positions during the rotation of the turret arms during the core transfer operation as well as the path of the web.

In FIG. 4 Turret Arm Assembly 9 (which is not shown) is in the horizontal position with Core 12*a* located on the right side with a full Bundle 8 of film wound on Core 12*a*. At this point in the operation Web 13 is wound around Transfer Lay-on Roll 40 and travels to Constant Contact Lay-on Roll 10*a*. Constant Contact Lay-on Roll 10*a* is held in contact with the outer surface of Bundle 8 by Lever Arms 27*a* and 27*a*′ Pivot Arms 16*a* and 16*a*′ are approximately horizontal and Lever Positioners 29*a* and 29*a*′ exert force on Lever Arms 27*a* and 27*a*′, this force is transmitted to Constant Contact Lay-on Roll 10*a* through Lever Arms 27*a* and 27*a*′.

On the left of Turret Arm Assembly 9 Core 12*b* is empty. Constant Contact Lay-on Roll 10*b* is fully retracted away from Core 12*b* and Lever Arms 27*b* and 27*b*′ are approximately vertical. As the transfer operation begins Turret Arm Assembly 9 is rotated in a clockwise direction. At the start of this transfer operation Pivot Arms 16*a* and 16*a*′ are horizontal and align with the horizontal axis of Turret Arm Assembly 9.

Figure 5:
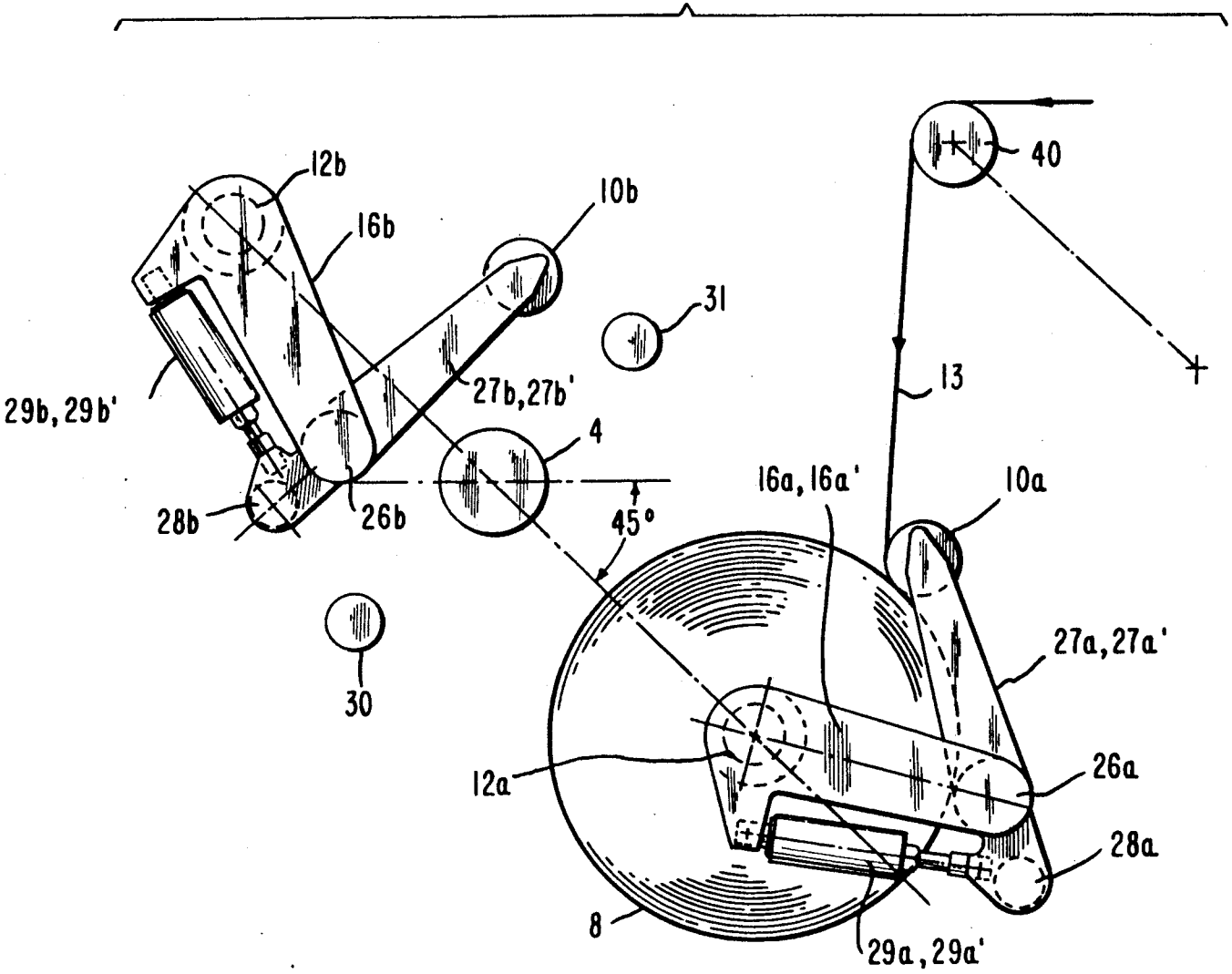

The next figure, FIG. 5, illustrates the position of the various components after Turret Arm Assembly 9 has rotated 45 degrees in a clockwise direction. At this point in the transfer operation Constant Contact Lay-on Roll 10*a* remains in contact with the surface of Bundle 8. Tension in Web 13 is maintained by Lever Positioners 29*a* and 29*a*′ acting through Lever Arms 27*a* and 27*a*′. Pivot Arms 16*a* and 16*a*′ have rotated counter clockwise relative to the axis of Turret Arm Assembly 9. Because of this rotation of Pivot Arms 16*a* and 16*a*′ the angle of wrap that Web 13 makes on Constant Contact Lay-on Roll 10*a* is essentially the same as the wrap angle illustrated in FIG. 4 at the beginning of the transfer operation.

Figure 6:
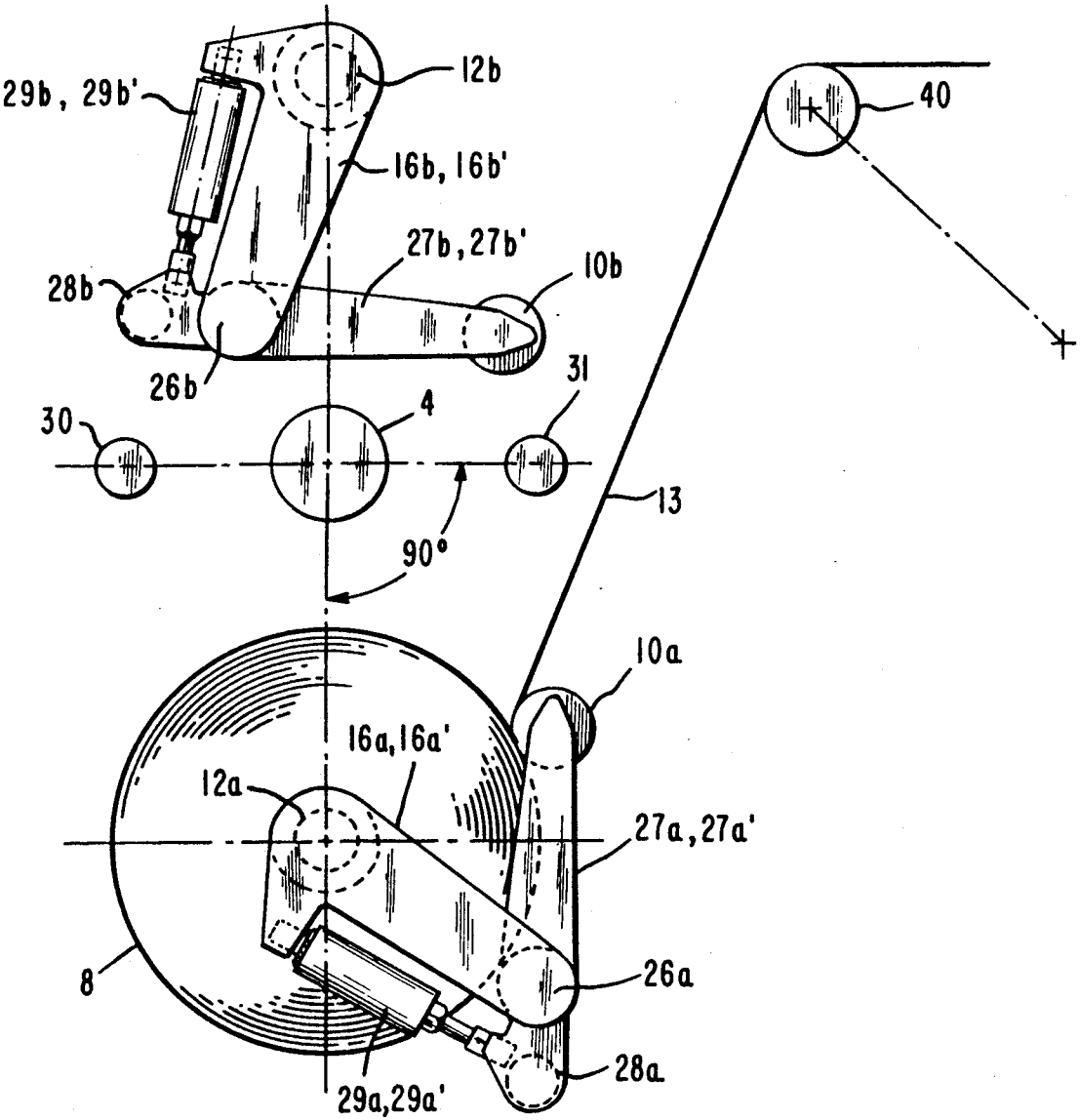

The next figure, FIG. 6, shows the components after 90 degrees of clockwise rotation of Turret Arm Assembly 9. Pivot Arms 16*a* and 16*a*′ have rotated further in a counter clockwise direction relative to the center line of Turret Arm Assembly 9. This rotation of Pivot Arms 16*a* and 16*a*′ result in positioning of Constant Contact Lay-on Roll 10*a* so that it continues to maintain an essentially constant wrap angle of Web 13 on Constant Contact Lay-on Roll 10*a*.

Figure 7:
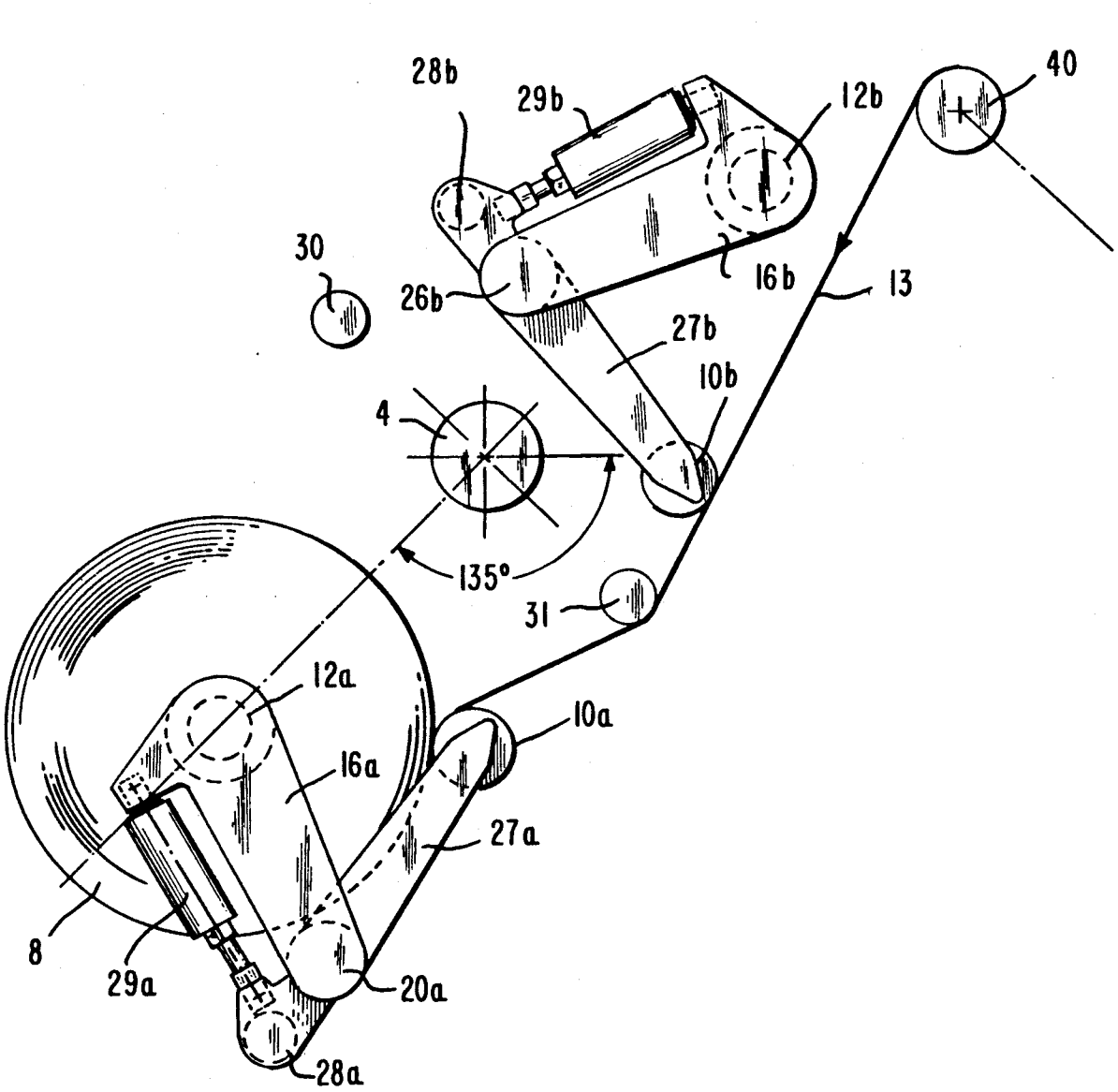

In FIG. 7 Turret Arm Assembly 9 has rotated 135 degrees clockwise from its initial position. At this point Web 13 has contacted Constant Contact Lay-on Roll 10*b* and Idler Roll 31. Pivot Arms 16*a* and 16*a* ′ have rotated further in a counter clockwise direction relative to the center line of Turret Arm Assembly 9. Here again the wrap angle between Web 13 and Constant Contact Lay-on Roll 10*a* has been maintained and Constant Contact Lay-on Roll 10*a* has remained in contact with the surface of Bundle 8.

Figure 8:
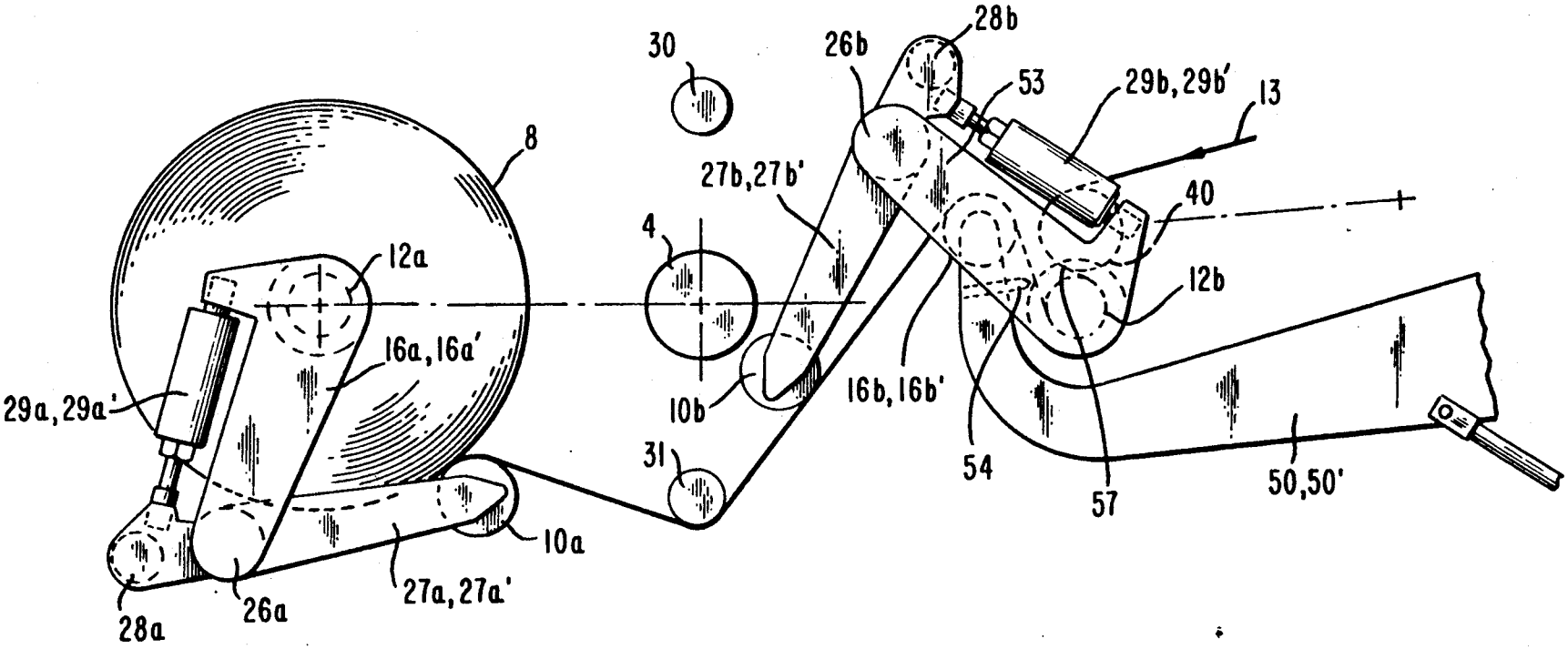

In the next figure, FIG. 8, Turret Arm Assembly 9 has rotated a full 180 degrees from its initial position. Here again the wrap angle of Web 13 around Constant Contact Lay-on Roll 10*a* is maintained. After Turret Arm Assembly 9 has reached this 180 degree rotation, Transfer Lay-on Roll 40 is brought into contact with Core 12b and J-arms 50 and 50′ are rotated clockwise by Jarm Positioners 52 and 52′ to bring J-arm Idler Roll 53 in contact with Web 13 as shown in FIG. 8. At this point in the operation Web Knife 54 is actuated to cut Web 13 between Core 12*b* and J-arm Idler Roll 53. When this cut is made one cut end of Web 13 is directed into nip 57 between Core 12*b* and Transfer Lay- CD on Roll 40 where Web 13 is picked up on Core 12*b* and winding commences. The sequence of operation illustrated in FIGS. 4 through 8 shows that as Web 13 is wound on Bundle 8 during the transfer operation the Wrap Angle 58 (as shown in FIG. 4) that Web 13 makes between the point that it first makes contact Constant Contact Lay-on Roll 10*a* and the point that it reaches Nip 57 where Constant Contact Lay-on Roll 10*a* contacts Bundle 8 is maintained essentially constant throughout the transfer operation. Maintaining Wrap Angle 58 constant while maintaining a constant tension in Web 13 and with constant pressure exerted by Lever Positioner 29*a* and 29*a*′ through Lever Arm 27 and 27*a*′ on Constant Contact Lay-on Roll 10*a* will produce constant pressure on Bundle 8 at Nip 57 and will produce a smooth bundle with the desired hardness. The remainder of cut off Web 13 is wound onto Bundle 8 on Core 12*a* completing Bundle 8.

Figure 9:
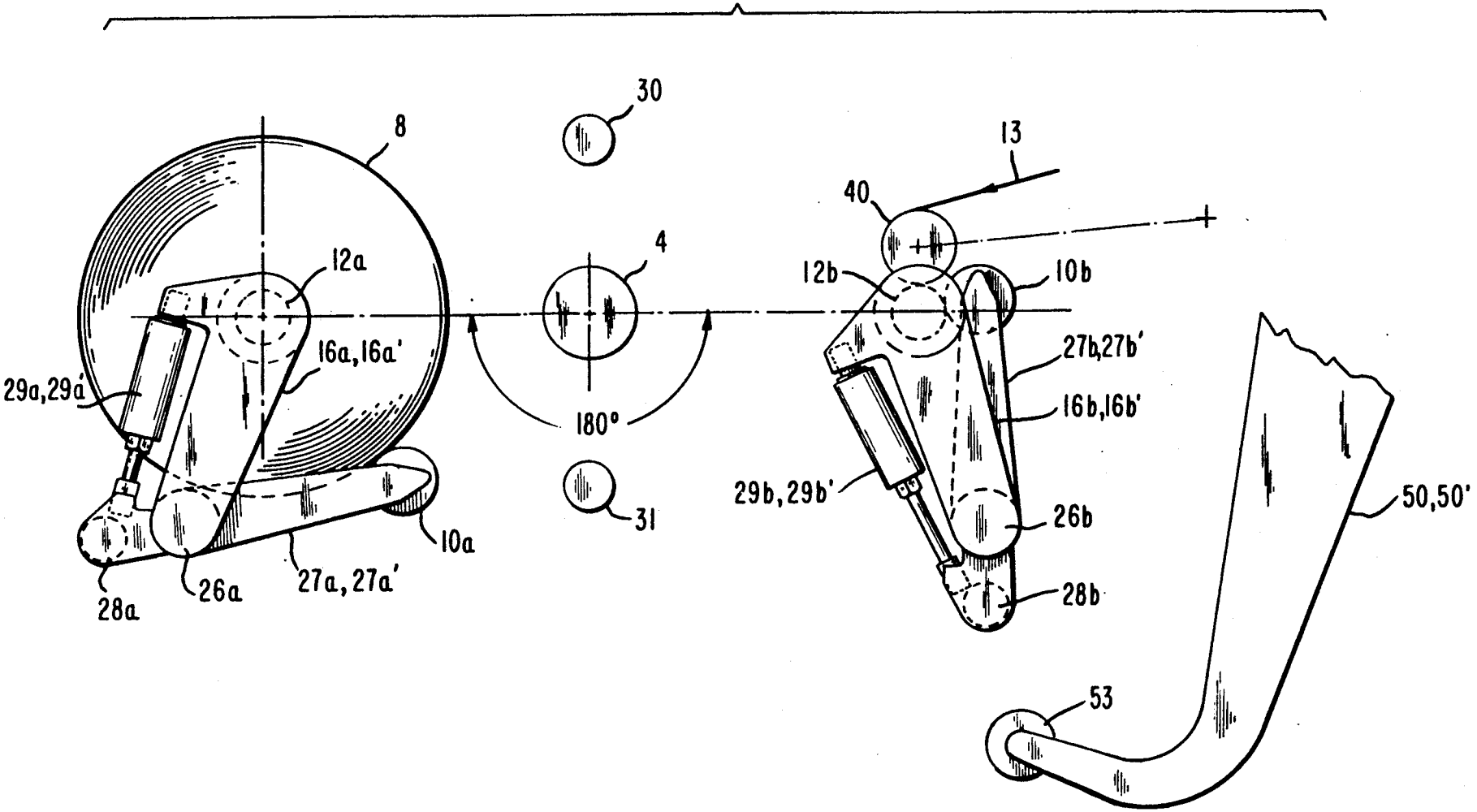

As Web 13 begins to accumulate on Core 12*b* and J-arms 50 and 50′ are retracted, Pivot Arms 16*b* and 16*b*′ are rotated counter clockwise and Lever Arm Positioners 29*b* and 29*b*′ extend fully and cause Lever Arms 27*b* and 27*b*′ to bring Constant Contact Lay-on Roll 10*b* into contact with Core 12*b* as shown in FIG. 9. At this point in the operation Web 13 is wound around Transfer Lay-on Roll 40 and from Transfer Lay-on Roll 40 which is in contact with Core 12*b* Web 13 travels under Constant Contact Lay-on Roll 10*b* as it accumulates on the new bundle.

Figure 10:
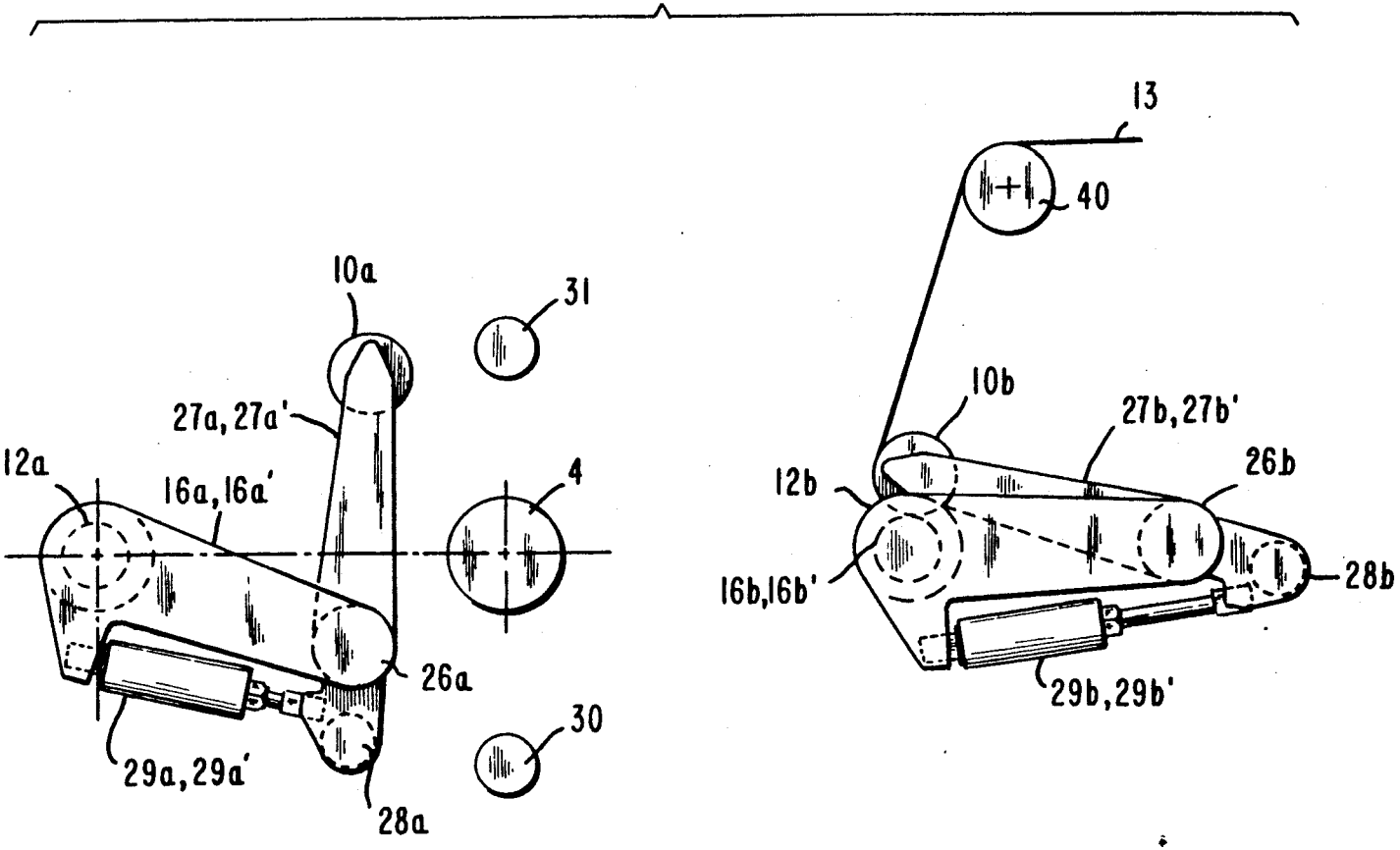
FIG. 10 shows the position of the articulated arm at beginning of the winding cycle after completion of the core transfer operation.

In the next step in the operation Transfer Lay-on Roll 40 is retracted from Core 12*b* to its initial position as illustrated in FIG. 4. Pivot Arms 16*b* and 16*b*′ are rotated again counter clockwise relative to the axis of Turret Arm Assembly 9 so that the center line of Pivot Arms 16*b* and 16*b*′ are horizontal and in line with the center line of Turret Arm Assembly 9 as shown in FIG. 10. Winding of Web 13 on the bundle accumulating on Core 12*b* continues until Bundle 8 of satisfactory diameter is accumulated on Core 12*b*. When the diameter of Bundle 8 is sufficient the transfer operation is repeated.

Figure 11:
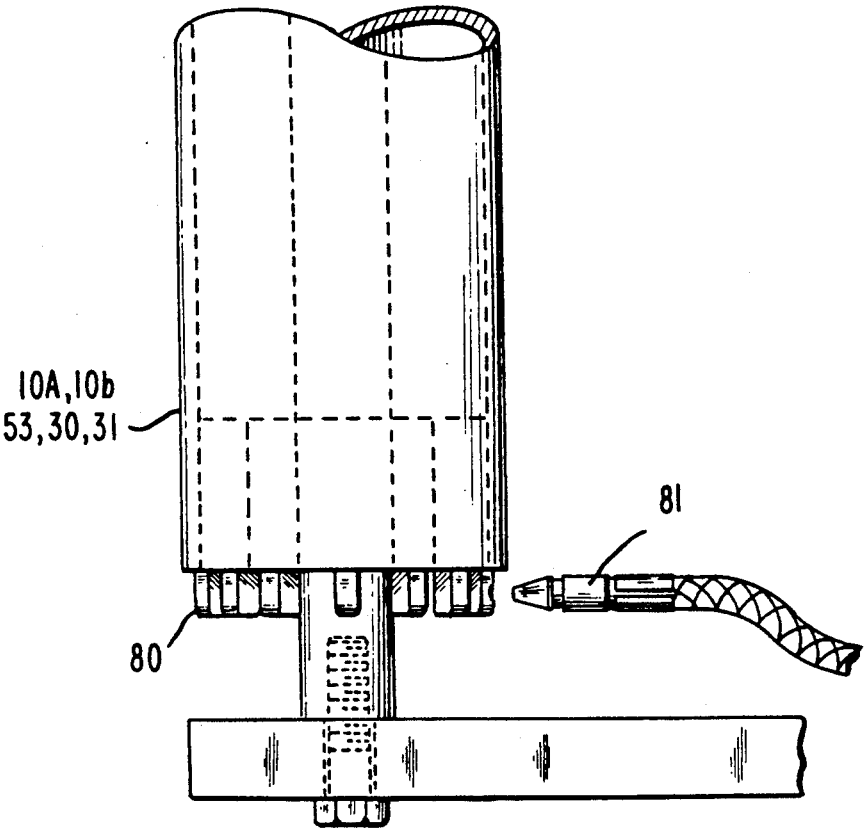
FIG. 11 illustrates vanes and an air nozzle used to initiate rotation of idler rolls

FIG. 11 illustrates the use of Idler Roll Vanes 80 and Air Nozzle 81. Vanes of this type are located on both ends of Idler Rolls 30 and 31 as well as J-Arm Idler Roll 53, Air Nozzle 81 is mounted in close proximity to each set of Idler Roll Vanes 80. Compressed air is directed through Air Nozzle 81 towards Idler Roll Vanes 80 to cause the Idler Roll to rotate. Rotation of J-Arm Idler Roll 53 is accomplished just prior to the time at which J-Arm Idler Roll 53 comes in contact with Web 13 to initiate cutting of Web 13 by Web Knife 54.

Rotation of Idler Rolls 30 and 31 are initiated in the same manner with compressed air through Nozzle 81.

Rotation in each of these Idler Rolls is initiated just prior to roll contact with Web 13 during the transfer operation. This step in the operation occurs when Turret Arm Assembly 9 has rotated approximately 135 degrees from its initial horizontal position as illustrated in FIG. 7 above.

Figure 12:
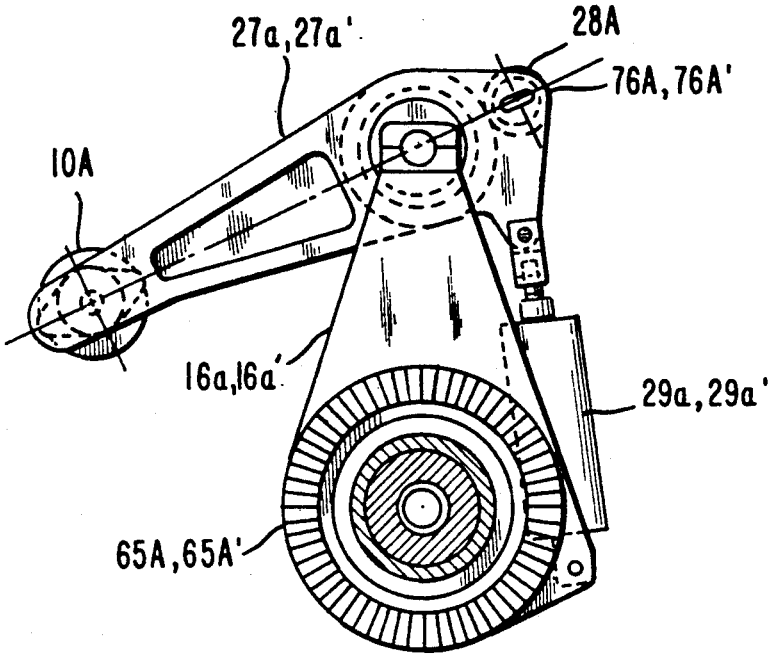
FIG. 12 illustrates the articulated arm assembly.

An important feature of this invention is the ability to control the pressure between the Constant Contact Lay-on Roll 10*a* or 10*b* and Bundle 8 as the bundle increases in diameter. This feature is accomplished by the following means. First Counter Weight 28*a* and 28*b* are designed to counter balance Constant Contact Lay-on Rolls 10*a* and 10*b* when mounted on their respective pairs of Lever Arms 27*a* and 27*a'* and 27*b* and 27b'. In the preferred embodiment the weight and approximate location of Counter Weights 28*a* and 28*b* are determined by conventional means to counter balance the respective moments of Constant Contact Lay-on Rolls 10*a* and 10*b* and their respective Lever Arms 27*a* and 27*a'* and 27*b* and 27*b'*. Final balancing is accomplished by slideably positioning the ends of each of Counter Weights 28*a* and 28*b* in Counter Weight Slots 76*a* and 76*a'* and 76*b* and 76*b'* located in respective Lever Arms 27*a* and 27*a'* and 27*b* and 27*b'* as illustrated in FIG. 12. When this balance is accomplished the weight of the various components in Articulated Arm Assemblies 7*a* and 7*b* do not influence the pressure that Constant Contact Lay-on Rolls 10*a* and 10*b* exert on film Bundle 8 as it is formed.

The pressure is determined by the geometric arrangement of various components, web tension and forces applied by Lever Positioners 29*a* and 29*a'* and 29*b* and 29*b'* on respective Constant Contact Lay-on Rolls 10*a* and 10*b*. These arrangements are described in detail below.

Figure 13:
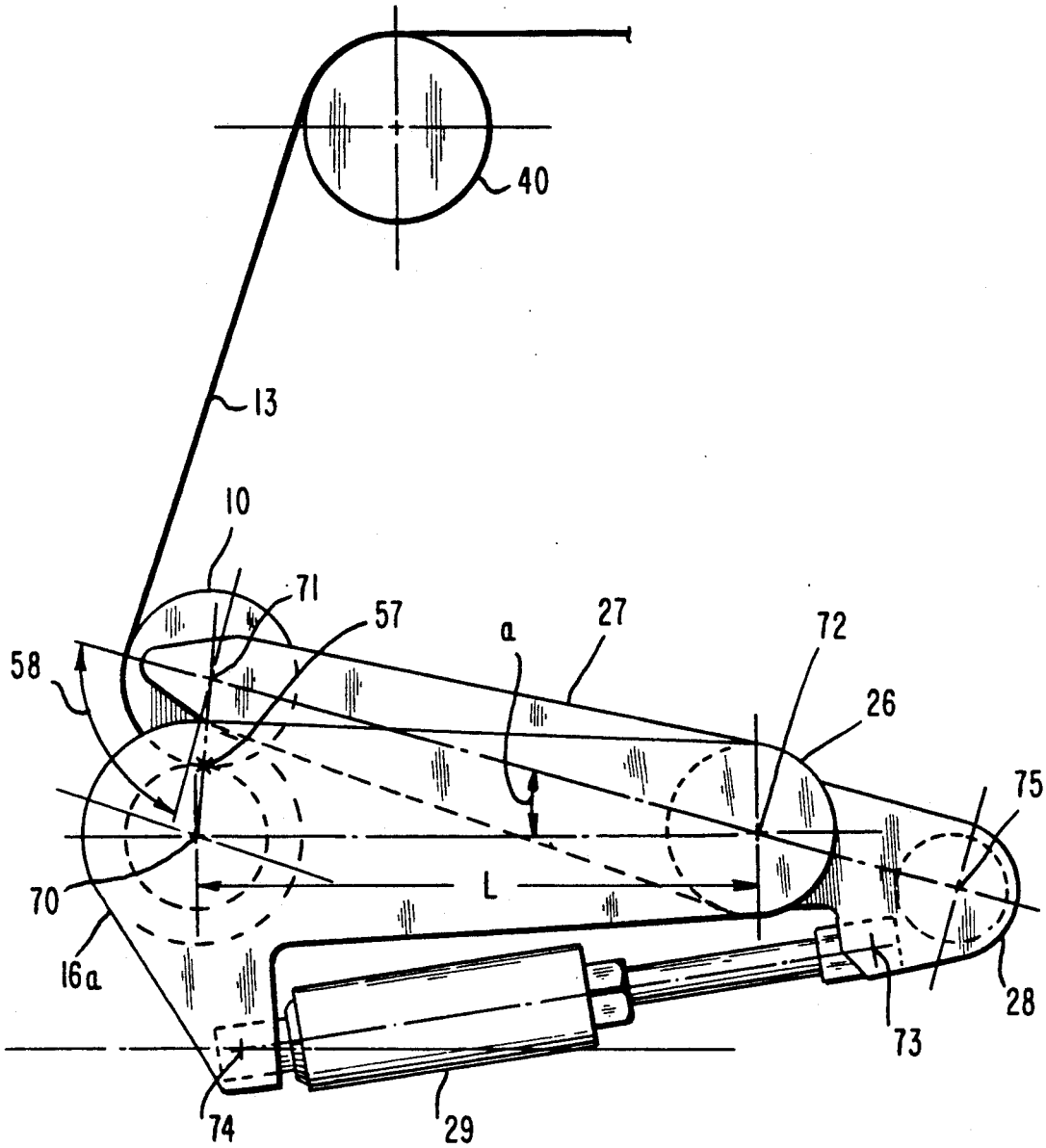
FIG. 13 and 13*a* illustrate the functioning of the articulated arm assembly.

FIG. 13 depicts the position of the various components of Arm Assembly 7 and Transfer Lay-on Roll 40 beginning the winding operation with Core 12*a* just beginning to accumulate incoming Web 13. The center line of Core 12*a* is located at point 70, the center line of Constant Contact Lay-on Roll 10*a* is located at point 71, the center line of pivot pin 26*a* is located at point 72, the center line of the point of attachment of Lever Positioner 29*a* is located at point 73, the opposite end of Lever Positioner 29 is mounted at point 74 on pivot Arm 16*a* and the center line of Counter Weight 28*a* is located at point 75 on Lever Arm 27*a*. Wrap Angle 58 is approximately 90 degrees at this state of the winding operation.

Figure 13A:
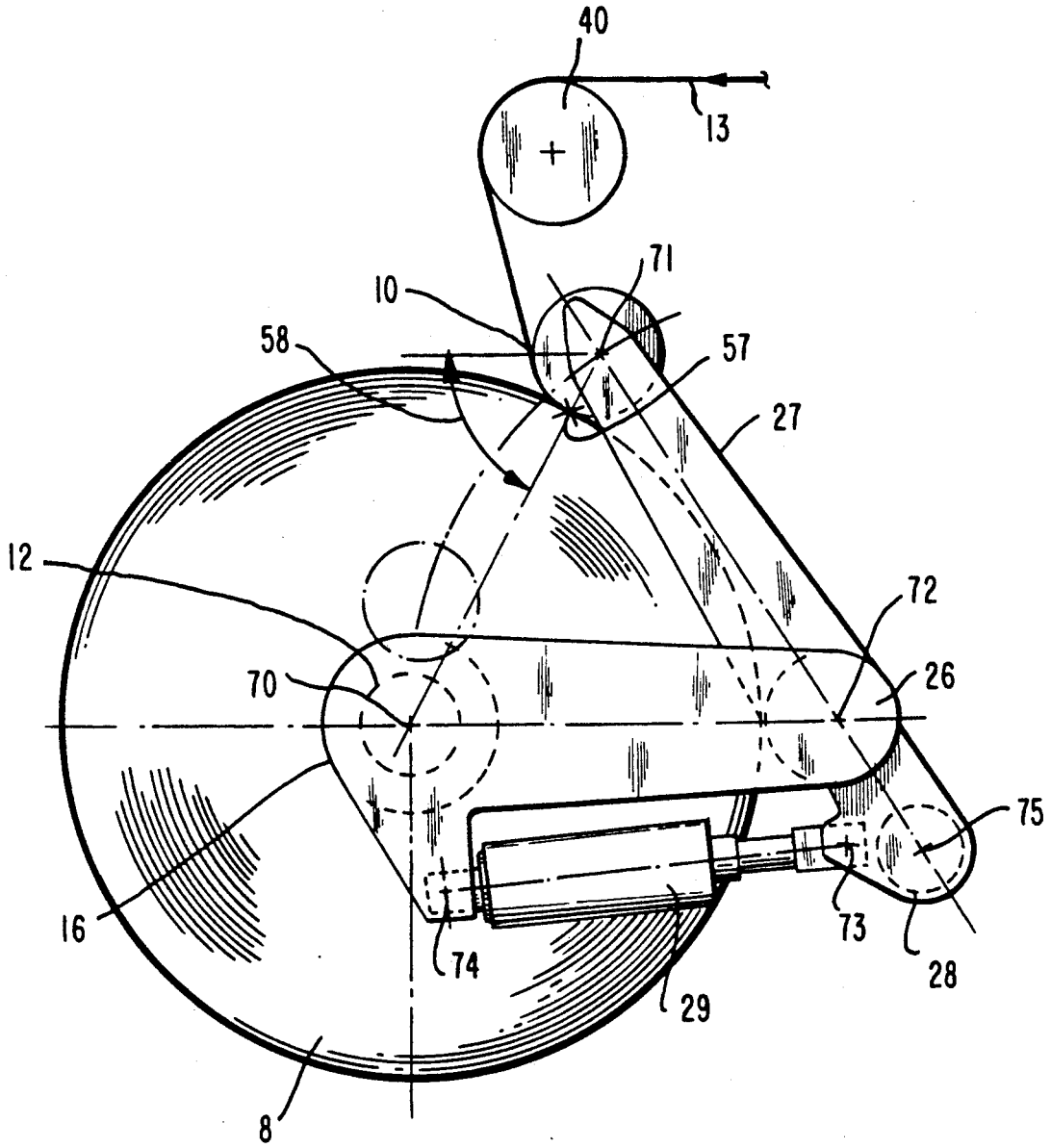

FIG. 13*a* depicts the components described in FIG. 13 with an accumulation of film forming Bundle 8 on Core 12*a*.

The force exerted by Constant Contact Lay-on Roll 10 on Core 12 and Bundle 8 is a function of the force applied to Constant Contact Lay-on Roll 10*a* from Lever Positioner 29*a* through Lever Arm 27*a*, the opposing force exerted on Constant Contact Lay-on Roll 10*a* by the tension in Web 13, and the relative location of the various center line points described above. Bundle 8 of approximately 24 inch diameter is depicted in FIG. 13*a* and Wrap Angle 58 is approximately 44 degrees.

The following terms are definitions for the purpose of illustrating how the instant invention accomplished the control of force exerted by Constant Contact Lay-on Roll 10 on film Bundle 8 as the bundle diameter increases.

| Term | Definition |
|---|---|
| F | Force exerted on bundle by Constant Contact Lay-on Roll |
| a | angle made between point 70, 72 and 71 |
| L | the distance between points 70 and 72 |
| P | the Forces exerted by Lever Positioner 29 on Lever Arm 27 at point 73 |
| T | Tension Force in Web 13 pulling against Constant Contact Lay-on Roll 10 |
| $M_C$ | the diameter of the core as it is being wound up. |
| $M_F$ | the perpendicular distance between point 72 and the line formed between points 73 and 74, (that is the line of action of force P). |
| $M_T$ | the perpendicular distance between points 72 and Web 13 as it passes from Transfer Lay-on Roll 40 to Constant Contact Lay-on Roll 10, (that is the line of action of web tension force T). |

In accordance with the teaching of the present invention $$F = \frac{P(M_F) - T(M_T)}{L} \cos(a/2)$$

Angle a increases as the diameter of Bundle 8 increases. As angle a increases Wrap Angle 58 decreases.

In the preferred embodiment, L, the distance between points 70 and 72 is 15 inches, the distance between points 71 and 72 is 15 inches. In addition diameter of Core 12*a* is 3.625 inches and the diameter of Constant Contact Lay-on Roll 10*a* is 4.5 inches in diameter. These dimensions were selected for design convenience for winding bundles up to 24 inches in diameter and the invention is not intended to be limited thereby.

In the preferred embodiment if force P and force T are maintained at constant values force F acting on Constant Contact Lay-on Roll 10 remains nearly constant for bundle diameter up to approximately 10 inches. Thereafter force P gradually declines up to the maximum bundle diameter of 24 inches.

The following table illustrates this variation in the preferred embodiment under the following conditions.

| Core Diameter = 3⅜ inches<br>F = 300 lbs.<br>T = 24 lbs.<br>L = 15 inches |
|---|
| $M_C$ at the start of winding = 5.54 inches<br>$M_C$ at Bundle diameter of 24 inches = 4.492 inches<br>$M_T$ at the start of winding = 17.023 inches<br>$M_T$ at Bundle diameter of 24 inches = 11.197 inches<br>a at the start of winding = 15.56 degrees<br>a at Bundle diameter of 24 inches = 56.72 degrees |

| Bundle Diameter inches | Wrap Angle degrees | Angle "a" degrees | Force on Bundle "F" lbs | Ratio of initial Force at Core Diameter to Force at Bundle diameter |
|---|---|---|---|---|
| 3.625 (Core) | | 15.5 | 82.9 | 1.00 |
| 4.0 | | 16.3 | 82.9 | 1.00 |
| 6.0 | | 20.2 | 84.0 | 1.01 |
| 8.0 | 89.6 | 24.0 | 83.3 | 1.01 |
| 10.0 | | 28.0 | 82.4 | 0.99 |
| 12.0 | 83.0 | 31.9 | 80.6 | 0.97 |
| 14.0 | | 35.9 | 79.0 | 0.95 |
| 16.0 | 74.0 | 40.0 | 76.3 | 0.92 |
| 18.0 | | 44.0 | 73.2 | 0.88 |
| 20.0 | 61.3 | 48.2 | 69.3 | 0.84 |
| 22.0 | | 52.4 | 64.8 | 0.78 |

-continued

| Bundle Diameter inches | Wrap Angle degrees | Angle "a" degrees | Force on Bundle "F" lbs | Ratio of initial Force at Core Diameter to Force at Bundle diameter |
|---|---|---|---|---|
| 24.0 | 44.1 | 56.7 | 59.6 | 0.72 |

It is clear from the above description that there are two distinct methods of varying the pressure at Nip 57 with the tension in Web 13 constant. The first method includes variation of the force exerted by Lever Arm Positioners 29a and 29a' at point 73 on Lever Arms 27a and 27a' and the second can be accomplished by varying Wrap Angle 58 by changing the relative position of Articulated Arm Assembly 7 relative to Transfer Lay-on Roll 40. By rotating Articulated Arm Assembly 7 as shown in FIG. 13 around the axis of Core 12a in a clockwise direction from the horizontal position towards the vertically down position, Wrap Angle 58 will decrease and the perpendicular distance between point 72 and Web 13 will also decrease the value of $M_T$ and reduce the pressure at Nip 57.

It can be seen that these methods of varying the pressure at Nip 57 can be combined using conventional means such as varying pressure to pneumatic cylinders which are used as Lever Positioners 29a and 29a' in the preferred embodiment and simultaneously using the rotation of Articulated Arm Assembly 7, to regulate the force exerted by Lever Positioners 29a and 29a' to produce virtually any type of pressure at Nip 57 while Web 13 is wound on Core 12a to form Bundle 8 while maintaining tension in Web 13 constant.

THEORY OF WEB TENSION CONTROL

Figure 14:
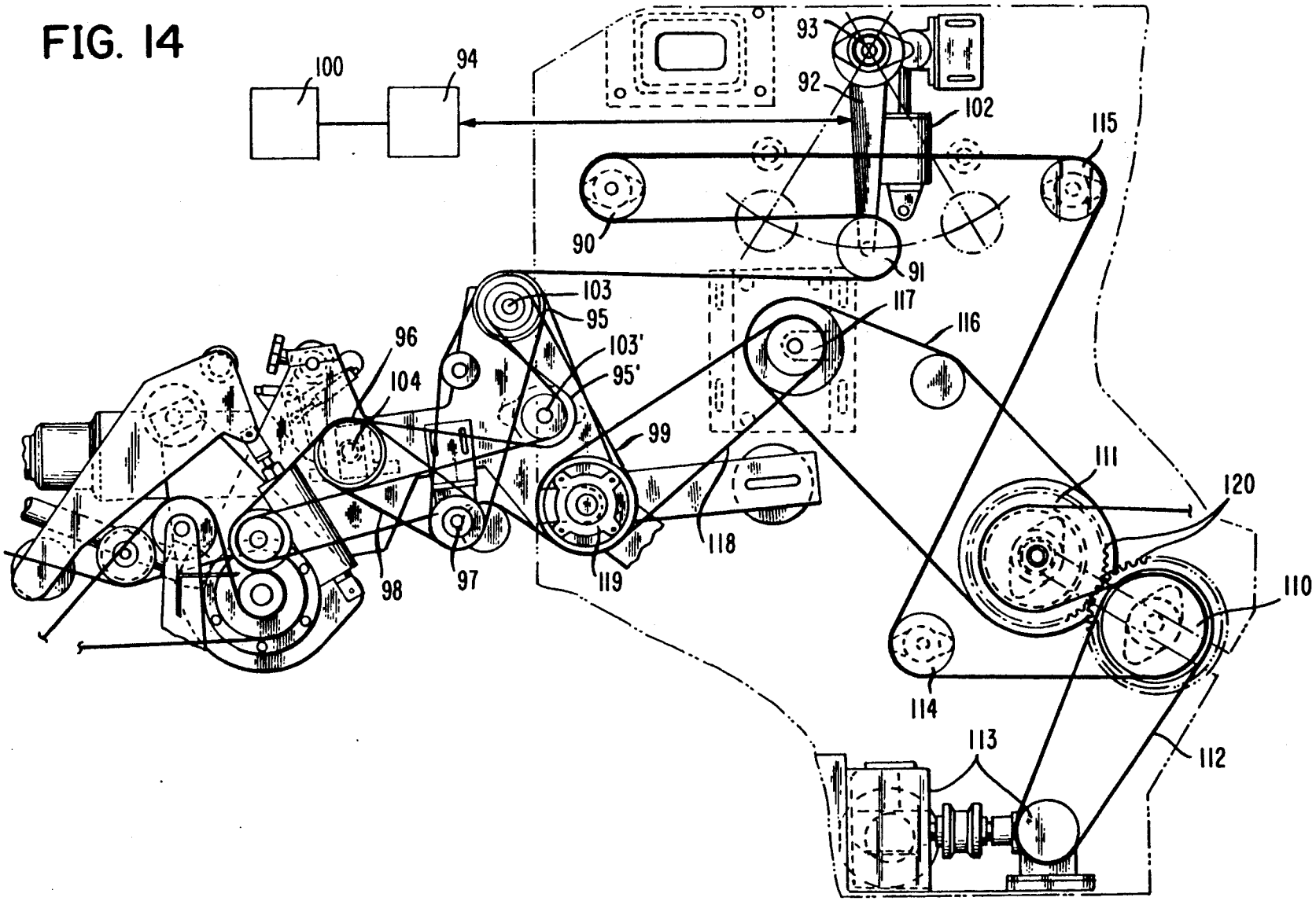
FIG. 14 illustrates the web feed-in mechanism and web tension control components.

This invention also incorporates an improved means to control tension in Web 13 which is illustrated in FIG. 14. In this figure Web 13 passes over Idler Roll 90 and then passes around Float Roll 91. Float Roll 91 is rotatably supported by Float Roll Arms 92 and 92' which in turn are pivotally mounted on Float Arm Pivot 93. Web 13 passes from Float Roll 91 over a pair of Feed Rolls 95 to Bowed Roll 96 and then to Transfer Lay-on Roll 40. Feed Rolls 95, 95' and Transfer Lay-on Roll 40 are rotated by Drive Belt 99 which is driven in a conventional manner by Belt Drive 101 in response to Core Chuck Speed Control 100 to effect feeding of Web 13 to Turret Winder 1. Drive Belt 99 drives Feed Rolls 95 and 95' through Drive Shafts 103 and 103' on which Feed Rolls 95 and 95' are rotatably mounted. Bowed Roll 96 is also rotated via Bowed Roll Clutch Belt 98 which is in turn driven from the output Bowed Roll Clutch 97. The input of Bowed Roll Clutch 97 is rotated by Drive Belt 99'which is in turn driven by Drive Shaft 103'. Float Roll Arm 92 is linked to Float Arm Motion Sensor 94 which is in turn linked to Core Clutch Speed Control 100.

There are two important aspects of Web 13 that should be controlled as Web 13 is fed into Turret Winder 1 during winding operations; the first is maintenance of an appropriated tension in Web 13 and the second is the removal of any wrinkles that may be present in Web 13 before it is wound on Bundle 8. The presence or absence of wrinkles in Web 13 is influenced by tension in Web 13. Often wrinkles are induced in Web 13 as tension is applied in the feeding of Web 13 to Turret Winder 1. Wrinkles are removed from Web 13 by Bowed Roll 96. As in conventional practice Bowed Roll 96 is curved slightly along its longitudinal axis so that the center of this roll is not concentric with its ends. In conventional practice Bowed Roll 96 is driven by Web 13 as it passes over Bowed Roll 96. This results in tension variations in Web 13 especially when there is a change in the velocity of Web 13 as it responds to change in the speed of Chuck Drive Motor 23a or 23b due to the fact that Bowed Roll 96 must be sped up or slowed down by forces exerted through Web 13. In the present invention Bowed Roll 96 is driven through an adjustable Bowed Roll Clutch 97 to which it is connected b Bowed Roll Clutch Belt 98. The inclusion of Bowed Roll Clutch 97 permits Bowed Roll 96 to be adjusted to rotate at a speed that matches the speed of Web 13 and also follows variations in the speed of Chuck Drive Motor 23a or 23b as the speed of Feed Rolls 95 and 95' respond to Core Chuck Speed Control 100. This ability to drive Bowed Roll 96 substantially improves the removal wrinkles in Web 13 and avoids tension variations in Web 13 which result from driving Bowed Roll 96 through Web 13.

In addition to the use of Bowed Roll Clutch 97 the present invention incorporates Float Roll 91, Float Roll Arms 92 and 92' which rotatably support Float Roll 91, Float Arm Pivot 93 to which Float Arms 92 and 92' are attached and Float Arm Tensioner 102 and Float Arm Movement Sensor 94. In the preferred embodiment of the invention the distance between Float Arm Pivot 93 and the center line of Float Roll 91 is 15 inches and Float Roll 91 which is normally horizontal is free to rotate in an arc approximately 30 degrees in either direction from this initial position in response to changes in tension in Web 13. Tension in Web 13 is initially adjusted by setting the pressure to a pneumatic cylinder used as Float Arm Tensioning Means 102 and adjusting the feeding of Web 13 to position Float Roll Arm 92 vertically. After the initial adjustment to Float Arm Tensioning Means 102 and Float Arm 92 to set tension in Web 13 if the tension increases Float Roll 91 is displaced to the left as shown in FIG. 14. This displacement is sensed by Float Arm Movement Sensor 94 and a signal is generated and directed to Core Chuck Speed Control 100. Core Chuck Speed Control 100 responds to this signal by reducing the rotational speed at which Bundle 8 is rotating thereby reducing the tension in Web 13. If the tension in Web 13 decreases a displacement to the right will occur and a signal will be generated to increase the rotational speed of Bundle 8 to restore the proper tension in Web 13. In the preferred embodiment Feed Rolls 95 and 95' which are rotatably mounted on Drive Shafts 103 and 103' do not significantly dampen the response of Float Roll Arm 92 to change in tension in Web 13 or speed changes in Chuck Drive Motor 23 because of the ability of Feed Rolls 95 and 95' to rotate independently from respective Drive Shafts 103 and 103'. This feature coupled with the substantial travel over which Float Roll 91 is capable of moving and the fact that Bowed Roll 96 is driven through Bowed Roll Clutch 97 is a significant improvement over conventional practice in which the bowed roll is driven by the web and produces more uniform tension and reduces wrinkles in Web 13.

From the foregoing description of the present invention there is described an improved Constant Contact Lay-on Roll Turret Winder which maintains Lay-On Roll contact with the accumulating bundle during the winding operation and the entire transfer operation. In addition, the wrap angle of the web on the Constant Contact Lay-on Roll is maintained essentially constant during the transfer operation. There is also described a mechanism which provides for the gradual reduction of Lay-on Roll pressure on the bundle of film as the bundle diameter increases. This reduction in pressure is accomplished without the use of conventional pressure regulating means such as those used to reduce air pressure on air cylinders as the bundle diameter increases. There is also described means for simultaneously varying wrap angle, Lay-on Roll pressure and web tension during the winding operation. There is also described a we feed in mechanism which provides for improved control of web tension and wrinkle removal.

The present invention has been described in connection with the details of an illustrative embodiment. It is understood that the present invention is not limited to the embodiment described herein but is intended to encompass modifications incorporating equivalent types of mechanisms that are within the scope of this invention as defined herein.

I claim:

1. An improved turret winding device comprising turret arms, and core chucks mounted on the turret arms, in which the improvement is comprised of:

a. a float roll;
b. one or more float arms upon which said float roll is rotatably mounted;
c. a float arm pivot upon which said float arms are rotatably mounted;
d. tensioning means which are attached to said float arms to provide tension in a web of film being fed into said turret winder;
e. a float arm movement sensor which is capable of detecting the displacement of said float arms;
f. a core chuck speed control which varies core chuck rotational speed in response to the displacement of said float arms;
g. a web feed drive;
h. one or more feed rolls, which are driven by said web feed drive at line speed;
i. a bowed roll; and
j. an adjustable clutch drive which drives said bowed roll in response to said web feed drive.

2. An improved turret winding device, wherein said turret winder incorporates idler rolls, in which the improvement is comprised of:

a. a float roll;
b. one or more float arms upon which said float roll is rotatably mounted;
c. a float arm pivot upon which said float arms are rotatably mounted;
d. tensioning means which are attached to said float arms to provide tension in a web of film being fed into said turret winder;
e. a float arm movement sensor which is capable of detecting the displacement of said float arms;
f. a core chuck speed control which varies core chuck rotational speed in response to the displacement of said float arms;
g. a web feed drive;
h. one or more feed rolls, which are driven by said web feed drive at line speed;
i. a bowed roll; and
j. an adjustable clutch drive which drives said bowed roll in response to said web feed drive.
k. vanes which are attached to one or more idler rolls; and
l. one or more air nozzles which direct compressed air at said vanes to impart rotation to said idler roll just prior to said roll coming into contact with said web.

3. An improved turret winding device, comprising turret arms, core chucks mounted on the turret arms, the core chucks defining a centerline, and idler rolls, in which the improvement is comprised of:

a. a constant contact lay-on roll;
b. one or more lever arms on which said constant contact lay-on roll is rotatably mounted;
c. a pivot pin on which said lever arms are rotatably mounted;
d. one or more pivot arms which support said pivot pin and which in turn are rotatably mounted concentric with the core chucks mounted on the turret arms of the turret winder;
e. one or more lever arm positioners which are mounted at a first end on said pivot arms and at a second end on said lever arms;
f. positioning means capable of positioning said pivot arms rotatably about the center line of said core chucks;
g. a float roll;
h. one or more float arms upon which said float roll is rotatably mounted;
i. a float arm pivot upon which said float arms are rotatably mounted;
j. tensioning means which are attached to said float arms to provide tension in a web of film being fed into said turret winder;
k. a float arm movement sensor which is capable of detecting the displacement of said float arms;
l. a core chuck speed control which varies core chuck rotational speed in response to the displacement of said float arms;
ml a web feed drive;
n. one or more free wheeling feed rolls, which are driven at line speed by said web feed drive;
o. a bowed roll;
p. an adjustable clutch drive which drives said bowed roll in response to said web feed drive.
q. vanes which are attached to one or more idler rolls and or constant lay-on roll; and
r. one or more air nozzles which direct compressed air at said vanes to impart rotation to said roll just prior to said roll coming into contact with said web.

4. An improved turret winding device, comprising turret arms, core chucks mounted on the turret arms, the core chucks defining a centerline, and idler rolls, in which the improvement is comprised of;

a. a constant contact lay-on roll;
b. one or more lever arms on which said constant contact lay-on roll is rotatably mounted;
c. a counter weight which is fixed to said lever arms to counter balance said constant contact lay-on roll;
d. a pivot pin on which said lever arms are rotatably mounted;
e. one or more pivot arms which support said pivot pin and which in turn are rotatably mounted concentric with the core chucks mounted on the turret arms of the turret winder;
f. one or more lever arm positioners which are mounted at a first end on said pivot arms and at a second end on said lever arms;

g. positioning means capable of positioning said pivot arms rotatably about the center line of said core chucks;

h. a float roll;

one or more float arms upon which said float roll is rotatably mounted;

j. a float arm pivot upon which said float arms are rotatably mounted;

k. tensioning means which are attached to said float arms to provide tension in a web of film being fed into said turret winder;

l. a float arm movement sensor which is capable of detecting the displacement of said float arms; and m. a core chuck speed control which varies core chuck rotational speed in response to the displacement of said float arms;

n. a web feed drive;

o. one or more free wheeling feed rolls, which are driven at line speed by said web feed drive;

o. a bowed roll;

p. an adjustable clutch drive which drives said bowed roll in response to said web feed drive;

q. vanes which are attached to one or more idler rolls and or constant contact lay-on roll; and r. one or more air nozzles which direct compressed air at said vanes to impart rotation to said roll just prior to said roll coming into contact with said web.

5. An improved method for winding bundles of film on turret winders comprising mounting one or more pivot arms rotatably and concentric with a core chuck;

winding a web on a rotating core; contacting the surface of a bundle with a lay-on roll;

maintaining a pressure on a lay-on roll;

varying the pressure during winding of the web to maintain constant hardness of said bundle;

adjusting a position of the lay-on roll during turret rotation to maintain contact between the constant contact lay-on roll and the bundle during turret rotation to maintain an essentially constant wrap angle between said web and said constant contact lay-on roll during said turret rotation;

directing compressed air at vanes attached to one or more idler rolls to impart rotation to said idler roll just prior to said roll coming into contact with said web.

* * * * *